US011602822B2

(12) United States Patent
Nienaber et al.

(10) Patent No.: US 11,602,822 B2
(45) Date of Patent: Mar. 14, 2023

(54) COATED ABRASIVE ARTICLE AND METHOD OF MAKING THE SAME

(71) Applicant: 3M INNOVATIVE PROPERTIES COMPANY, St. Paul, MN (US)

(72) Inventors: Aaron K. Nienaber, Maplewood, MN (US); Joseph B. Eckel, Vadnais Heights, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 17/049,521

(22) PCT Filed: Apr. 16, 2019

(86) PCT No.: PCT/IB2019/053145
§ 371 (c)(1),
(2) Date: Oct. 21, 2020

(87) PCT Pub. No.: WO2019/207416
PCT Pub. Date: Oct. 31, 2019

(65) Prior Publication Data

US 2021/0046614 A1 Feb. 18, 2021

Related U.S. Application Data

(60) Provisional application No. 62/661,762, filed on Apr. 24, 2018.

(51) Int. Cl.
*B24D 18/00* (2006.01)
*B24D 3/04* (2006.01)
(Continued)

(52) U.S. Cl.
CPC ..... *B24D 18/0072* (2013.01); *B24D 3/04* (2013.01); *B24D 11/001* (2013.01); *B24D 11/02* (2013.01)

(58) Field of Classification Search
CPC ..... B24D 18/007; B24D 3/04; B24D 11/011; B24D 11/02
See application file for complete search history.

(56) References Cited

U.S. PATENT DOCUMENTS 2,033,991 A 3/1936 Melton
2,857,879 A * 10/1958 Johnson ..... B24D 11/005 427/195
(Continued)

FOREIGN PATENT DOCUMENTS

CN 101780664 A 7/2010
CN 104999385 10/2015
(Continued)

OTHER PUBLICATIONS

Barbee, "Microstructure of Amorphous 304 Stainless steel-carbon alloys synthesized by magnetron sputter deposition", Thin Solid Films, 1979, vol. 63, pp. 143-150.
(Continued)

*Primary Examiner* — Pegah Parvini

(57) ABSTRACT

A method of making a coated abrasive article is disclosed. A backing has first and second opposed major surfaces. A make layer precursor is disposed on at least a portion of the first major surface. Magnetizable abrasive particles are disposed onto the make layer precursor while under the influence of an applied magnetic field. At least a majority the magnetizable abrasive particles extend away from the make layer precursor in an orientation substantially aligned with the applied magnetic field. Non-magnetizable particles are then disposed onto the make layer precursor while under the influence of the applied magnetic field. At least some of the non-magnetizable particles are disposed between the magnetizable abrasive particles. Then, the make layer precursor is at least partially cured to provide a make layer.

15 Claims, 2 Drawing Sheets

(51) Int. Cl.
*B24D 11/00* (2006.01)
*B24D 11/02* (2006.01)

(56) References Cited

U.S. PATENT DOCUMENTS

| | | | |
|---|---|---|---|
| 3,041,156 | A | 6/1962 | Rowse |
| 4,314,827 | A | 2/1982 | Leitheiser |
| 1,910,444 | A | 5/1983 | Nicholson |
| 4,518,397 | A | 5/1985 | Leitheiser |
| 4,612,242 | A | 9/1986 | Vesley |
| 4,623,364 | A | 11/1986 | Cottringer |
| 4,652,275 | A | 3/1987 | Bloecher |
| 4,734,104 | A | 3/1988 | Broberg |
| 4,737,163 | A | 4/1988 | Larkey |
| 4,744,802 | A | 5/1988 | Schwabel |
| 4,770,671 | A | 9/1988 | Monroe |
| 4,799,939 | A | 1/1989 | Bloecher |
| 4,881,951 | A | 11/1989 | Wood |
| 4,927,431 | A | 5/1990 | Buchanan |
| 4,997,461 | A | 3/1991 | Markhoff-Matheny |
| 5,009,675 | A | 4/1991 | Kunz |
| 5,011,508 | A | 4/1991 | Wald |
| 5,042,991 | A | 8/1991 | Kunz |
| 5,078,753 | A | 1/1992 | Broberg |
| 5,085,671 | A | 2/1992 | Martin |
| 5,090,968 | A | 2/1992 | Pellow |
| 5,108,463 | A | 4/1992 | Buchanan |
| 5,137,542 | A | 8/1992 | Buchanan |
| 5,139,978 | A | 8/1992 | Wood |
| 5,152,917 | A | 10/1992 | Pieper |
| 5,201,916 | A | 4/1993 | Berg |
| 5,203,884 | A | 4/1993 | Buchanan |
| 5,213,590 | A | 5/1993 | Neff |
| 5,213,591 | A | 5/1993 | Celikkaya |
| 5,227,104 | A | 7/1993 | Bauer |
| 5,328,716 | A | 7/1994 | Buchanan |
| 5,352,254 | A | 10/1994 | Celikkaya |
| 5,366,523 | A | 10/1994 | Rowenhorst |
| 5,417,726 | A | 5/1995 | Stout |
| 5,435,816 | A | 7/1995 | Spurgeon |
| 5,498,269 | A | 3/1996 | Larmie |
| 5,505,747 | A | 4/1996 | Chesley |
| 5,560,753 | A | 10/1996 | Buchanan |
| 5,565,011 | A | 10/1996 | Follett |
| 5,573,619 | A | 11/1996 | Benedict |
| RE35,570 | E | 7/1997 | Rowenhorst |
| 5,672,097 | A | 9/1997 | Hoopman |
| 5,700,302 | A | 12/1997 | Stoetzel |
| 5,946,991 | A | 9/1999 | Hoopman |
| 5,975,987 | A | 11/1999 | Hoopman |
| 5,984,988 | A | 11/1999 | Berg |
| 6,129,540 | A | 10/2000 | Hoopman |
| 6,843,815 | B1 | 1/2005 | Thurber |
| 7,727,931 | B2 | 6/2010 | Brey |
| 8,034,137 | B2 | 10/2011 | Erickson |
| 8,142,531 | B2 | 3/2012 | Adefris |
| 8,142,532 | B2 | 3/2012 | Erickson |
| 8,142,891 | B2 | 3/2012 | Culler |
| 8,551,577 | B2 | 10/2013 | Moren |
| 8,698,394 | B2 | 4/2014 | McCutcheon |
| 2009/0165394 | A1 | 7/2009 | Culler |
| 2009/0169816 | A1 | 7/2009 | Erickson |
| 2012/0227333 | A1 | 9/2012 | Adefris |
| 2012/0231711 | A1* | 9/2012 | Keipert ..... C09K 3/1409 51/295 |
| 2013/0040537 | A1 | 2/2013 | Schwabel |
| 2013/0125477 | A1 | 5/2013 | Adefris |
| 2013/0344786 | A1 | 12/2013 | Keipert |
| 2014/0290147 | A1* | 10/2014 | Seth ..... B24D 11/04 51/298 |
| 2016/0221153 | A1 | 8/2016 | Rizzo, Jr. |
| 2017/0225298 | A1 | 8/2017 | Goers |
| 2018/0029194 | A1 | 2/2018 | Keipert |

FOREIGN PATENT DOCUMENTS

| | | |
|---|---|---|
| WO | WO 2000-64588 | 11/2000 |
| WO | WO 2011-139562 | 11/2011 |
| WO | WO 2014-176108 | 10/2014 |
| WO | WO 2015-100220 | 7/2015 |
| WO | WO 2018-080703 | 5/2018 |
| WO | WO 2018-080704 | 5/2018 |
| WO | WO 2018-080705 | 5/2018 |
| WO | WO 2018-080755 | 5/2018 |
| WO | WO 2018-080756 | 5/2018 |
| WO | WO 2018-080784 | 5/2018 |
| WO | WO 2018-080799 | 5/2018 |
| WO | WO 2018-134732 | 7/2018 |
| WO | WO 2018-136268 | 7/2018 |
| WO | WO 2018-136269 | 7/2018 |
| WO | WO 2018-136271 | 7/2018 |
| WO | WO 2019-207415 | 10/2019 |
| WO | WO 2019-207417 | 10/2019 |

OTHER PUBLICATIONS

International Search Report for PCT International Application No. PCT/IB2019/053145, dated Jul. 23, 2019, 4 pages.

* cited by examiner

COATED ABRASIVE ARTICLE AND METHOD OF MAKING THE SAME

TECHNICAL FIELD

The present disclosure broadly relates to methods of making coated abrasive articles.

BACKGROUND

Coated abrasive articles are conventionally made by coating abrasive particles onto a make layer precursor disposed on a backing. The make precursor layer is then at least partially cured to form a make layer where the abrasive particles are bound to the backing by the make layer. A size layer precursor is disposed on the make layer and abrasive particles, and the size layer precursor is cured. Optionally, but commonly, a supersize layer (which may contain, grinding aids, lubricants, etc.) is disposed on the size layer. The make and size layers generally include a thermosetting resin (e.g., phenolic resin, aminoplast resin, curable acrylic resin, cyanate resin, or a combination thereof).

Orientation of the abrasive particles in coated abrasive articles generally has an influence on abrading properties. In the instance that the abrasive particles are precisely-shaped (e.g., into triangular platelets or conical particles), this effect of orientation can be especially important.

Various methods of positioning shaped abrasive particles are known. For example, U.S. Pat. Appl. Publ. No. US 2013/0344786 1 (Keipert) discloses a coated abrasive article having a plurality of formed ceramic abrasive particles each having a surface feature. The plurality of formed ceramic abrasive particles attached to a flexible backing by a make coat comprising a resinous adhesive forming an abrasive layer. The surface feature having a specified z-direction rotational orientation, and the specified z-direction rotational orientation occurs more frequently in the abrasive layer than would occur by a random z-direction rotational orientation of the surface feature.

Similarly, WO 2015/100220 A1 (Culler et al.) discloses a coated abrasive article maker apparatus including a first web path guiding a production tool such that it wraps a portion of the outer circumference of an abrasive particle transfer roll; a second web path for a resin coated backing guiding the resin coated backing such that it wraps a portion of the outer circumference of the abrasive particle transfer roll with the resin layer positioned facing the dispensing surface of the production tool this is positioned between the resin coated backing and the outer circumference of the abrasive particle transfer roll; and wherein abrasive particles are transferred from cavities in the production tool to the resin coated backing as the resin coated backing and the production tool traverse around the abrasive particle transfer roll.

U.S. Pat. Appl. Publ. 2016/0221153 A1 (Rizzo, Jr.) describes that abrasive grains may be alignable in response to being exposed to an electrical current and/or a magnetic field. The abrasive grains may be aligned of a film that is processed into a grinding wheel.

SUMMARY

The present disclosure provides alternative practical methods for making coated abrasive articles the rely on an applied magnetic field during application of magnetizable abrasive particles to the make layer precursor, thereby influencing their final orientation in the coated abrasive article.

Advantageously, coated abrasive articles prepared according to the present disclosure exhibit superior abrading performance properties as compared to coated abrasive articles made of the same components, in a similar manner, but wherein the non-magnetizable particles are deposited on the make layer precursor substantially outside the influence of the applied magnetic field. Moreover, curing of the make layer precursor can be accomplished at a later point substantially outside the influence of the magnetic field without the magnetizable abrasive particles losing their orientation.

Accordingly, in one aspect, the present disclosure provides a method of making a coated abrasive article, the method comprising sequentially:

providing a backing having first and second opposed major surfaces, wherein a make layer precursor is disposed on at least a portion of the first major surface;

disposing non-magnetizable particles onto the make layer precursor, wherein at least some of the non-magnetizable particles are disposed between the magnetizable abrasive particles while under the influence of the applied magnetic field; and at least partially curing the make layer precursor to provide a make layer.

In some embodiments, the method further comprises:

disposing a size layer precursor over at least a portion of the make layer, magnetizable abrasive particles, and non-magnetizable particles; and at least partially curing the size layer precursor layer to provide a size layer.

In another aspect, the present disclosure provides a coated abrasive article made according to the method of present disclosure.

As used herein:

The term "applied magnetic field" refers to a magnetic field that is deliberately created and excludes those generated by any natural (e.g., astronomical) body or bodies (e.g., Earth or the sun) or are the accidental result of environmental electric circuits (e.g., architectural electrical wiring).

The term "aspect ratio" refers to the ratio length/thickness of an object.

The term "crushed abrasive particle" refers to an abrasive particle that is formed through a mechanical fracturing process, and specifically excludes abrasive particles that are evidently formed into shaped abrasive particles by a molding operation and then fractured. The material fractured to produce the crushed abrasive particle may be in the form of bulk abrasive or an abrasive precursor. It may also be in the form of an extruded rod or other profile or an extruded or otherwise formed sheet of abrasive or abrasive precursor. Mechanical fracturing includes for example roll or jaw crushing as well as fracture by explosive comminution.

The term "essentially free of" means containing less than 5 percent by weight (e.g., less than 4, 3, 2, 1, 0.1, or even less than 0.01 percent by weight, or even completely free) of, based on the total weight of the object being referred to.

The term "ferrimagnetic" refers to materials that exhibit ferrimagnetism. Ferrimagnetism is a type of permanent magnetism that occurs in solids in which the magnetic fields associated with individual atoms spontaneously align themselves, some parallel, or in the same direction (as in ferromagnetism), and others generally antiparallel, or paired off in opposite directions (as in antiferromagnetism). The magnetic behavior of single crystals of ferrimagnetic materials may be attributed to the parallel alignment; the diluting effect of those atoms in the antiparallel arrangement keeps the magnetic strength of these materials generally less than that of purely ferromagnetic solids such as metallic iron.

Ferrimagnetism occurs chiefly in magnetic oxides known as ferrites. The spontaneous alignment that produces ferrimagnetism is entirely disrupted above a temperature called the Curie point, characteristic of each ferrimagnetic material. When the temperature of the material is brought below the Curie point, ferrimagnetism revives.

The term "ferromagnetic" refers to materials that exhibit ferromagnetism. Ferromagnetism is a physical phenomenon in which certain electrically uncharged materials strongly attract others. In contrast to other substances, ferromagnetic materials are magnetized easily, and in strong magnetic fields the magnetization approaches a definite limit called saturation. When a field is applied and then removed, the magnetization does not return to its original value. This phenomenon is referred to as hysteresis. When heated to a certain temperature called the Curie point, which is generally different for each substance, ferromagnetic materials lose their characteristic properties and cease to be magnetic; however, they become ferromagnetic again on cooling.

The term "length" refers to the longest dimension of an object.

The term "magnet" can include a ferromagnetic material that responds to a magnetic field and acts as a magnet. A "magnet" can be any material that exerts a magnetic field in either a permanent, semi-permanent, or temporary state. The term "magnet" can be one individual magnet or an assembly of magnets that would act like a single magnet. The term "magnet" can include permanent magnets and electromagnets.

The terms "magnetic" and "magnetized" mean being ferromagnetic or ferrimagnetic at 20° C., or capable of being made so, unless otherwise specified. Preferably, magnetizable layers according to the present disclosure either have, or can be made to have by exposure to an applied magnetic field, a magnetic moment of at least 0.001 electromagnetic units (emu), more preferably at least 0.005 emu, more preferably 0.01 emu, up to an including 0.1 emu, although this is not a requirement.

The term "magnetizable" means capable of being magnetized or already in a magnetized state.

The term "platey crushed abrasive particle", which refers to a crushed abrasive particle resembling a platelet and/or flake that is characterized by a thickness that is less than the width and length. For example, the thickness may be less than ½, ⅓, ¼, ⅕, ⅙, ⅐, ⅛, ⅑, or even less than 1/10 of the length and/or width. Likewise, the width may be less than ½, ⅓, ¼, ⅕, ⅙, ⅐, ⅛, ⅑, or even less than 1/10 of the length.

The terms "precisely-shaped abrasive particle" refers to an abrasive particle wherein at least a portion of the abrasive particle has a predetermined shape that is replicated from a mold cavity used to form a precursor precisely-shaped abrasive particle that is sintered to form the precisely-shaped abrasive particle. A precisely-shaped abrasive particle will generally have a predetermined geometric shape that substantially replicates the mold cavity that was used to form the abrasive particle.

The term "shaped abrasive particle" refers to a ceramic abrasive particle that has been intentionally shaped (e.g., extruded, die cut, molded, screen-printed) at some point during its preparation such that the resulting abrasive particle is non-randomly shaped. The term "shaped abrasive particle" as used herein excludes abrasive particles obtained by a mechanical crushing or milling operation.

The term "substantially" means within 35 percent (preferably within 30 percent, more preferably within 25 percent, more preferably within 20 percent, more preferably within 10 percent, and more preferably within 5 percent) of the attribute being referred to.

The suffix "(s)" indicates that the modified word can be singular or plural.

The term "thickness" refers to the longest dimension of an object that is perpendicular to both of its length and width.

The term "width" refers to the longest dimension of an object that is perpendicular to its length.

Features and advantages of the present disclosure will be further understood upon consideration of the detailed description as well as the appended claims.

Figure 1:
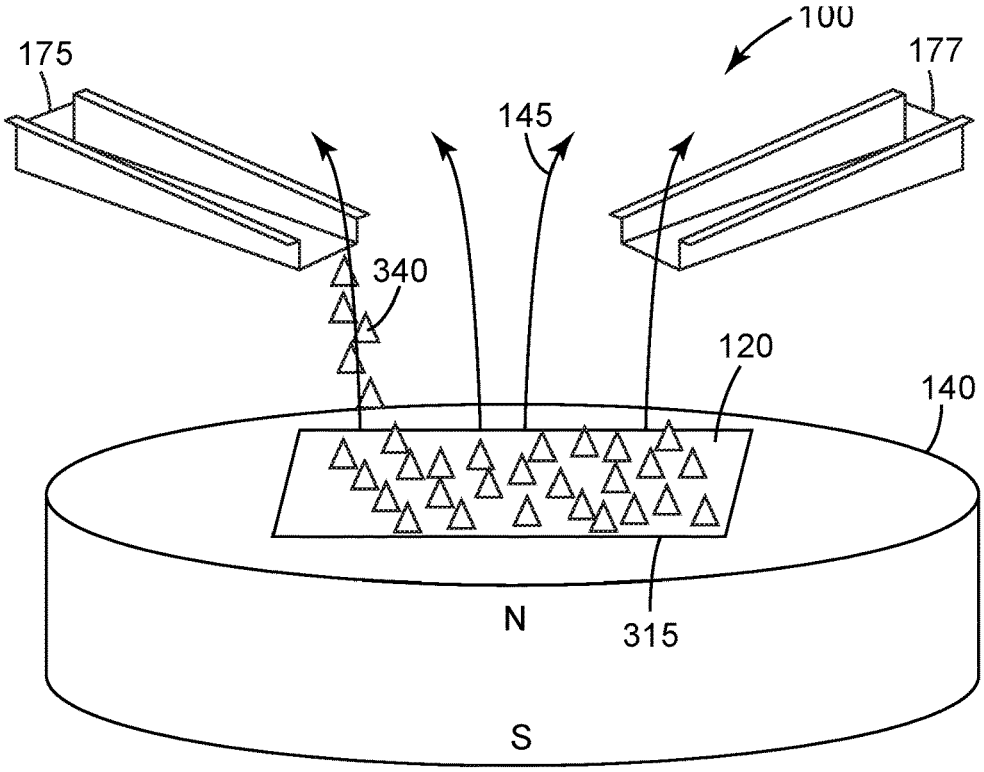
FIG. 1 is a schematic view of a first portion of an exemplary method according to the present disclosure in which magnetizable abrasive particles are disposed on a make layer precursor.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

FIG. 1 depicts an exemplary process 100 for making a coated abrasive article according to the present disclosure.

Figure 3:
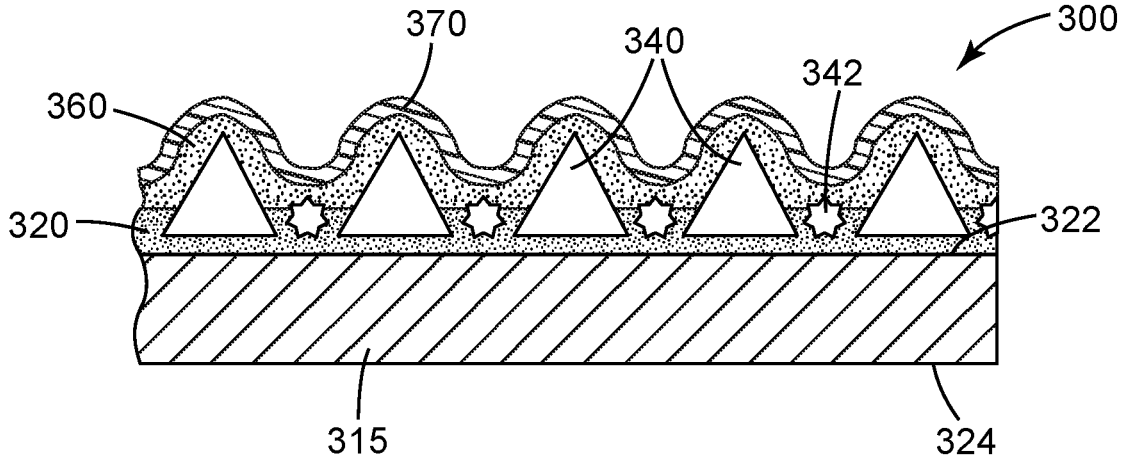
FIG. 3 is a schematic side view of a coated abrasive article 300 prepared according to the method of the present disclosure.

Referring now to FIG. 3, which shows an exemplary coated abrasive article 300 prepared according to the method of the present disclosure, make layer 320 is disposed on backing 315. Size layer 360 overlays make layer 320 and magnetizable abrasive particles 340 and non-magnetizable particles 342 thereby securing them to backing 315. Optional supersize layer 370 overlays size layer 360. Backing 315 has first and second opposed major surfaces (322, 324) with make layer 320 disposed thereon. Make layer 320 comprises a first curable binder precursor (not shown).

Referring again to FIG. 1, magnetizable abrasive particles 340 are dropped from first hopper 175 through a portion of an applied magnetic field 145 created by magnet 140 onto make layer precursor 120, which is disposed on backing 315. Magnet 140 has north (N) and south (S) poles. Once deposited onto make layer precursor 120, magnetizable abrasive particles 340 are substantially aligned with the applied magnetic field, causing them to extend substantially perpendicularly outwardly from the make layer precursor 120.

Figure 2:
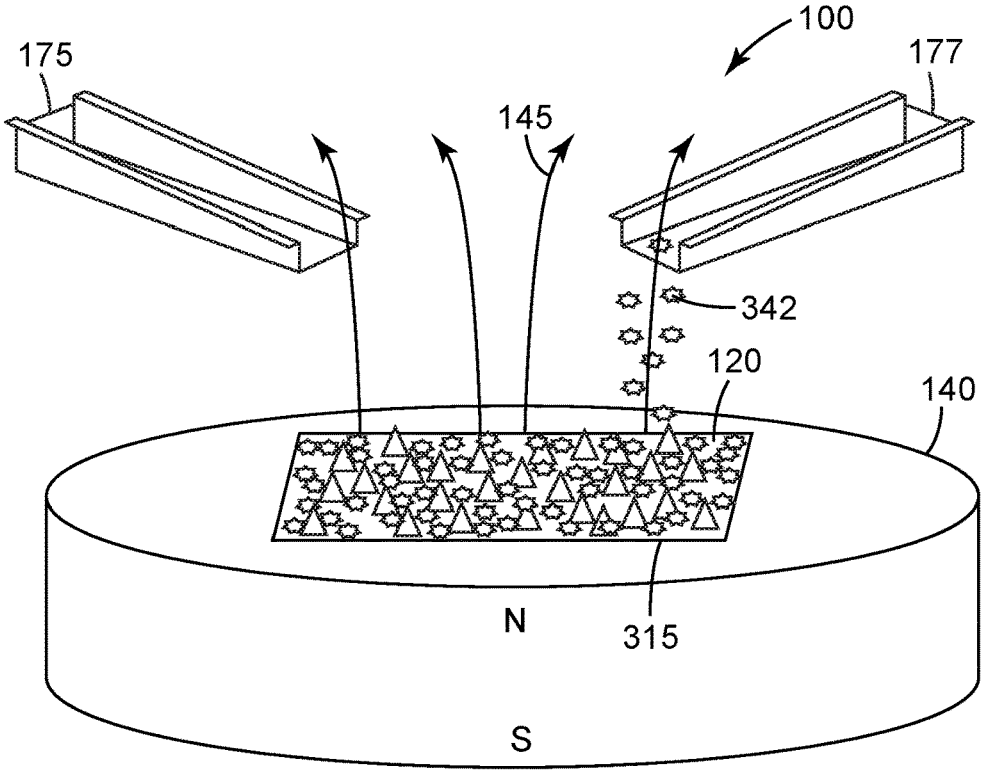
FIG. 2 is a schematic view of a second portion of the exemplary method according to the present disclosure in which non-magnetizable particles are disposed on a make layer precursor.

Referring now to FIG. 2, subsequently, non-magnetizable particles 342 are deposited onto make layer precursor 120 from second hopper 177 while still under the influence of applied magnetic field. At least partial curing of the make layer precursor may occur at this time or at a later time at a location away from the applied magnetic field. Without wishing to be bound by theory, it is believed that the non-magnetizable particles fill in gaps between the magnetizable abrasive particles thereby reducing their ability to lose their orientation (e.g., fall over) when no longer in the applied magnetic field.

In general, applied magnetic fields used in practice of the present disclosure have a field strength in the region of the magnetizable particles being affected (e.g., attracted and/or oriented) of at least about 10 gauss (1 mT), preferably at least about 100 gauss (10 mT), and more preferably at least about 1000 gauss (0.1 T), although this is not a requirement.

The applied magnetic field can be provided by one or more permanent magnets and/or electromagnet(s), for example. Preferred permanent magnets include rare-earth magnets comprising magnetizable materials are described hereinabove. The applied magnetic field can be static or variable (e.g., oscillating). The applied magnetic field may be provided by upper and/or lower magnetic members, each having north (N) and south (S) poles, and which may be monolithic or they may be composed of multiple component magnets and/or magnetizable bodies, for example. If comprised of multiple magnets, the multiple magnets in a given magnetic member should preferably be contiguous and/or co-aligned (e.g., at least substantially parallel) with respect to their magnetic field lines where the components magnets closest approach each other.

Once the magnetizable abrasive particles and non-magnetizable particles are disposed onto the make layer precursor, it is at least partially cured at a first curing station so as to firmly retain the magnetizable abrasive particles and non-magnetizable particles in position.

In some embodiments, additional magnetizable and/or non-magnetizable particles (e.g., filler abrasive particle and/or grinding aid particles) can be applied to the make layer precursor prior to curing.

A size layer precursor is typically applied over the at least partially cured make layer precursor, magnetizable abrasive particles, although this is not a requirement. If present, the size layer precursor is then at least partially cured at a second curing station, optionally with further curing of the at least partially cured make layer precursor. In some embodiments, a supersize layer is disposed on the at least partially cured size layer precursor.

Lastly, the finished web is converted into useful forms of coated abrasive articles such as, for example, discs, sheets, and/or belts.

As will be apparent to those of skill in the art, the make layer precursor, optional size layer precursor, and optional supersize layer can be coated using conventional techniques such as, for example, gravure coating, curtain coating, knife coating, spray coatings, roll-coating, reverse roll gravure coating, or bar coating.

Exemplary backings include those known in the art for making coated abrasive articles, including conventional sealed coated abrasive backings and porous non-sealed backings. Typically, the backing has two opposed major surfaces. The thickness of the backing generally ranges from about 0.02 to about 5 millimeters, desirably from about 0.05 to about 2.5 millimeters, and more desirably from about 0.1 to about 0.4 millimeter, although thicknesses outside of these ranges may also be useful.

The backing may be flexible or rigid. Desirably the backing is flexible. Exemplary backings include polymeric film (including primed films) such as polyolefin film (e.g., polypropylene including biaxially oriented polypropylene, polyester film, polyamide film, cellulose ester film), metal foil, mesh, foam (e.g., natural sponge material or polyurethane foam), cloth (e.g., cloth made from fibers or yarns comprising polyester, nylon, silk, cotton, and/or rayon), paper, vulcanized paper, vulcanized fiber, nonwoven materials, combinations thereof, and treated versions thereof. Cloth backings may be woven or stitch bonded. Desirably, the backing comprises polypropylene film.

The backing may be made of any number of various materials including those conventionally used as backings in the manufacture of coated abrasives. Examples include paper, cloth, film, polymeric foam, vulcanized fiber, woven and nonwoven materials, combinations of two or more of these materials, as well as treated versions thereof. The backing may also be a laminate of two materials (e.g., paper/film, cloth/paper, film/cloth).

The backing may be treated to include a presize (i.e., a barrier coat overlying the major surface of the backing onto which the abrasive layer is applied), a backsize (i.e., a barrier coat overlying the major surface of the backing opposite the major surface on which the abrasive layer is applied), a saturant (i.e., a barrier coat that is coated on all exposed surfaces of the backing), or a combination thereof. Useful presize, backsize, and saturant compositions include glue, phenolic resins, lattices, epoxy resins, urea-formaldehyde, urethane, melamine-formaldehyde, neoprene rubber, butyl acrylate, styrol, starch, and combinations thereof. Other optional layers known in the art may also be used (e.g., a tie layer; see, e.g., U.S. Pat. No. 5,700,302 (Stoetzel et al.)).

Backing treatments may contain additional additives such as, for example, a filler and/or an antistatic material (for example, carbon black particles, vanadium pentoxide particles). The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.).

Typically, at least one major surface of the backing is smooth (for example, to serve as the first major surface). The second major surface of the backing may comprise a slip resistant or frictional coating. Examples of such coatings include an inorganic particulate (e.g., calcium carbonate or quartz) dispersed in an adhesive.

The backing may contain various additive(s). Examples of suitable additives include colorants, processing aids, reinforcing fibers, heat stabilizers, UV stabilizers, and antioxidants. Examples of useful fillers include clays, calcium carbonate, glass beads, talc, clays, mica, wood flour; and carbon black.

The backing may be a fibrous reinforced thermoplastic such as described, for example, as described, for example, in U.S. Pat. No. 5,417,726 (Stout et al.), or an endless spliceless belt, for example, as described, for example, in U.S. Pat. No. 5,573,619 (Benedict et al.). Likewise, the backing may be a polymeric substrate having hooking stems projecting therefrom such as that described, for example, in U.S. Pat. No. 5,505,747 (Chesley et al.). Similarly, the backing may be a loop fabric such as that described, for example, in U.S. Pat. No. 5,565,011 (Follett et al.)

The make layer precursor and the size layer precursor include respective curable binder precursor compositions, which may be the same or different.

Examples of curable binder precursor compositions for use in the make and/or size layer precursors include phenolic resins, urea-formaldehyde resins, acrylate resins, urethane resins, epoxy resins, aminoplast resins, and combinations thereof. The curable binder precursor compositions can also include various additives including, for example, plasticizers, fillers, fibers, lubricants, surfactants, wetting agents, dyes, pigments, antifoaming agents, dyes, coupling agents, plasticizers, and suspending agents, for example.

Depending on any curable binder precursor composition selected, an appropriate curative may be added to facilitate curing. Such curatives will be readily apparent to those of skill in the art, and may be thermally activated, photochemically activated, or both, for example.

Examples of useful supersize layer compositions include metal salts of fatty acids, urea-formaldehyde, novolac phenolic resins, epoxy resins, waxes, and mineral oils.

The magnetizable abrasive particles have sufficient magnetic susceptibility that they can be influenced (e.g., attracted) by the applied magnetic field. Any magnetizable abrasive particle may be used. In some preferred embodiments, the magnetizable abrasive particles have a magnetizable layer disposed on at least a portion of the outer surface of a non-magnetizable particle. For example, otherwise non-magnetic (e.g., non-magnetizable) particles can be rendered magnetizable by coating some or all of the particle surface with a magnetizable material coating.

Examples of magnetizable coatings include coatings of an adhesive (e.g., waterglass) and magnetizable particles such as, for example, ferromagnetic metals, and/or ferromagnetic metal oxides. In this method, the outer surfaces of abrasive particles are moistened with waterglass. As used herein, the term "waterglass" refers to an aqueous solution of alkali silicate(s) (e.g., lithium, sodium, and/or potassium silicate) and combinations thereof. Alkali silicate is the common name for compounds with the formula $(SiO_2)_n(M_2O)$ and their hydrates where n is a positive integer and M is an alkali metal (e.g., sodium or potassium). A well-known member of this series is sodium metasilicate, $Na_2SiO_3$ (i.e., n=1, M=Na), which is commercially available in anhydrous and hydrated forms (e.g., $Na_2SiO_3 \cdot 5\ H_2O$). While water should generally be the primary liquid component, organic co-solvents (e.g., methanol, ethanol, isopropanol, glyme, diglyme, propylene glycol, and/or acetone) may also be present. Other components such as, for example, surfactant(s), thickener(s), thixotrope(s), and colorant(s), may be included in the waterglass if desired. The concentration of alkali silicate in the waterglass is not critical (as long as it is dissolved and the waterglass is liquid), but it is preferably from 25 to 70 percent by weight, more preferably 30 to 55 percent by weight. In this context, percent by weight is to be calculated based on the anhydrous form of alkali silicate(s) that is/are present in the waterglass.

Magnetizable particles included with the waterglass may comprise magnetizable materials such as, for example: iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, alloys of neodymium, iron and boron (e.g., $Nd_2Fe_{14}B$), and alloys of samarium and cobalt (e.g., $SmCo_5$); MnSb; $MnOFe_2O_3$; $Y_3Fe_5O_{12}$; $CrO_2$; MnAs; ferrites such as ferrite, magnetite; zinc ferrite; nickel ferrite; cobalt ferrite, magnesium ferrite, barium ferrite, and strontium ferrite; yttrium iron garnet; and combinations of the foregoing. In some preferred embodiments, the magnetizable material comprises at least one metal selected from iron, nickel, and cobalt, an alloy of two or more such metals, or an alloy of at one such metal with at least one element selected from phosphorus and manganese. In some preferred embodiments, the magnetizable material is an alloy containing 8 to 12 weight percent (wt. %) aluminum, 15 to 26 wt. % nickel, 5 to 24 wt. % cobalt, up to 6 wt. % copper, up to 1% titanium, wherein the balance of material to add up to 100 wt. % is iron.

In some other embodiments, a magnetizable layer can be deposited on a non-magnetizable abrasive particle body using a vapor deposition technique such as, for example, physical vapor deposition (PVD) including magnetron sputtering. PVD metallization of various metals, metal oxides and metallic alloys is disclosed in, for example, U.S. Pat. No. 4,612,242 (Vesley) and U.S. Pat. No. 7,727,931 (Brey et al.).

Examples of metallic materials that can be vapor-deposited include stainless steels, nickel, cobalt. Exemplary useful magnetizable particles/materials can comprise: iron; cobalt; nickel; various alloys of nickel and iron marketed as Permalloy in various grades; various alloys of iron, nickel and cobalt marketed as Fernico, Kovar, FerNiCo I, or FerNiCo II; various alloys of iron, aluminum, nickel, cobalt, and sometimes also copper and/or titanium marketed as Alnico in various grades; alloys of iron, silicon, and aluminum (typically about 85:9:6 by weight) marketed as Sendust alloy; Heusler alloys (e.g., $Cu_2MnSn$); manganese bismuthide (also known as Bismanol); rare earth magnetizable materials such as gadolinium, dysprosium, holmium, europium oxide, and alloys of samarium and cobalt (e.g., $SmCo_5$); MnSb; ferrites such as ferrite, magnetite; zinc ferrite; nickel ferrite; cobalt ferrite, magnesium ferrite, barium ferrite, and strontium ferrite; and combinations of the foregoing. In some embodiments, the magnetizable material comprises at least one metal selected from iron, nickel, and cobalt, an alloy of two or more such metals, or an alloy of at one such metal with at least one element selected from phosphorus and manganese. In some embodiments, the magnetizable material is an alloy containing 8 to 12 weight percent (wt. %) aluminum, 15 to 26 wt. % nickel, 5 to 24 wt. % cobalt, up to 6 wt. % copper, up to 1 wt. % titanium, wherein the balance of material to add up to 100 wt. % is iron. Alloys of this type are available under the trade designation "ALNICO".

Any ratio of magnetizable abrasive particles to non-magnetizable particles may be used. In some embodiments, the weight percentage of the magnetizable abrasive particles to the total weight of particles may be at least 5 percent, at least 15 percent, at least 25 percent, at least 40 percent, at least 45 percent, at least 50 percent, at least 55 percent, at least 60 percent, at least 65 percent, at least 70 percent, at least 75 percent, at least 80 percent, at least 85 percent, at least 90 percent, or even at least 95 percent. In some embodiments, the weight percentage of the non-magnetizable particles to the total weight of particles may be at least 5 percent, at least 15 percent, at least 25 percent, at least 35 percent, at least 40 percent, at least 45 percent, at least 50 percent, at least 55 percent, at least 60 percent, at least 65 percent, at least 70 percent, at least 75 percent, at least 80 percent, at least 85 percent, at least 90 percent, or even at least 95 percent.

The magnetizable abrasive particles may have a monomodal or polymodal (e.g., bimodal, trimodal) distribution.

The magnetizable abrasive particles and the non-magnetizable particles may comprise the same or different base material compositions. In some preferred embodiments, the magnetizable abrasive particles have a magnetizable layer disposed on at least a portion of an abrasive particle.

The magnetizable abrasive particles, whether crushed or shaped, should have sufficient hardness and surface roughness to function as abrasive particles in an abrading process. Preferably, the magnetizable abrasive particles (e.g., exclusive of any magnetizable layer that may be present thereon) have a Mohs hardness of at least 4, at least 5, at least 6, at least 7, or even at least 8.

Useful abrasive materials that can be used in magnetizable and optionally non-magnetizable particles include, for example, fused aluminum oxide, heat treated aluminum oxide, white fused aluminum oxide, ceramic aluminum oxide materials such as those commercially available as 3M CERAMIC ABRASIVE GRAIN from 3M Company of St. Paul, Minn., black silicon carbide, green silicon carbide, titanium diboride, boron carbide, tungsten carbide, titanium carbide, cubic boron nitride, garnet, fused alumina zirconia, sol-gel derived ceramics (e.g., alumina ceramics doped with chromia, ceria, zirconia, titania, silica, and/or tin oxide), silica (e.g., quartz, glass beads, glass bubbles and glass fibers), feldspar, or flint. Examples of sol-gel derived crushed ceramic particles can be found in U.S. Pat. No. 4,314,827 (Leitheiser et al.), U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.).

As discussed previously, the magnetizable abrasive particles may be shaped (e.g., precisely-shaped) or random (e.g., crushed). Applying a magnetizable coating to the surface of a non-magnetizable shaped abrasive particle may result in a shaped magnetizable abrasive particle. Shaped abrasive particles and precisely-shaped abrasive particles can be prepared, for example, by a molding process using sol-gel technology as described in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina particles that have been formed in a specific shape, then crushed to form shards that retain a portion of their original shape features. Exemplary shapes of abrasive particles include crushed, pyramids (e.g., 3-, 4-, 5-, or 6-sided pyramids), truncated pyramids (e.g., 3-, 4-, 5-, or 6-sided truncated pyramids), cones, truncated cones, rods (e.g., cylindrical, vermiform), and prisms (e.g., 3-, 4-, 5-, or 6-sided prisms).

Magnetizable abrasive particles may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). ANSI grade designations (i.e., specified nominal grades) include, for example: ANSI 4, ANSI 6, ANSI 8, ANSI 16, ANSI 24, ANSI 36, ANSI 46, ANSI 54, ANSI 60, ANSI 70, ANSI 80, ANSI 90, ANSI 100, ANSI 120, ANSI 150, ANSI 180, ANSI 220, ANSI 240, ANSI 280, ANSI 320, ANSI 360, ANSI 400, and ANSI 600. FEPA grade designations include F4, F5, F6, F7, F8, F10, F12, F14, F16, F20, F22, F24, F30, F36, F40, F46, F54, F60, F70, F80, F90, F100, F120, F150, F180, F220, F230, F240, F280, F320, F360, F400, F500, F600, F800, F1000, F1200, F1500, and F2000. JIS grade designations include JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS600, JIS800, JIS1000, JIS1500, JIS2500, JIS4000, JIS6000, JIS8000, and JIS10,000

Examples of non-magnetizable shaped abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina crushed abrasive particles that have been formed in a specific shape, then crushed to form shards that retain a portion of their original shape features. In some embodiments, shaped alpha alumina particles are precisely-shaped (i.e., the particles have shapes that are at least partially determined by the shapes of cavities in a production tool used to make them. Details concerning such crushed abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

In embodiments wherein the magnetizable abrasive particles and/or non-magnetizable particles are shaped as triangular platelets, they may have a major surface with a vertex of 90 degrees (corresponding to a right triangle), or they may have a major surface with a vertex of greater than 90 degrees (corresponding to an obtuse triangle), although this is not a requirement. Examples include at least 91 degrees, at least 95 degrees, at least 100 degrees, at least 110 degrees, at least 120 degrees, or even at least 130 degrees.

In some preferred embodiments, the non-magnetizable particles comprise crushed abrasive particles (including platey crushed abrasive particles). Such abrasive particles can be obtained by known methods, from commercial suppliers, and/or by shape sorting such crushed abrasive particles; for example, using a shape-sorting table as is known in the art.

Examples of suitable abrasive particles include crushed abrasive particles comprising fused aluminum oxide, heat-treated aluminum oxide, white fused aluminum oxide, ceramic aluminum oxide materials such as those commercially available as 3M CERAMIC ABRASIVE GRAIN from 3M Company, St. Paul, Minn., brown aluminum oxide, blue aluminum oxide, silicon carbide (including green silicon carbide), titanium diboride, boron carbide, tungsten carbide, garnet, titanium carbide, diamond, cubic boron nitride, garnet, fused alumina zirconia, iron oxide, chromia, zirconia, titania, tin oxide, quartz, feldspar, flint, emery, sol-gel-derived ceramic (e.g., alpha alumina), and combinations thereof. Further examples include crushed abrasive composites of abrasive particles (which may be platey or not) in a binder matrix, such as those described in U.S. Pat. No. 5,152,917 (Pieper et al.). Many such abrasive particles, agglomerates, and composites are known in the art.

Preferably, crushed abrasive particles comprise ceramic crushed abrasive particles such as, for example, sol-gel-derived polycrystalline alpha alumina particles. Ceramic crushed abrasive particles composed of crystallites of alpha alumina, magnesium alumina spinel, and a rare earth hexagonal aluminate may be prepared using sol-gel precursor alpha alumina particles according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Examples of sol-gel-derived abrasive particles from which crushed abrasive particles can be isolated, and methods for their preparation can be found, in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.). It is also contemplated that the crushed abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the crushed abrasive particles may be surface-treated with a coupling agent (e.g., an organosilane coupling agent) or other physical treatment (e.g., iron oxide or titanium oxide) to enhance adhesion of the crushed abrasive particles to a binder. The crushed abrasive particles may be treated before combining them with the binder, or they may be surface treated in situ by including a coupling agent to the binder.

Further details concerning methods of making sol-gel-derived abrasive particles can be found in, for example, U.S. Pat. No. 4,314,827 (Leitheiser); U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appin. No. 2009/0165394 A1 (Culler et al.).

Surface coatings on the various abrasive particles may be used to improve the adhesion between the abrasive particles and a binder in abrasive articles, or can be used to aid in electrostatic deposition. In one embodiment, surface coatings as described in U.S. Pat. No. 5,352,254 (Celikkaya) in an amount of 0.1 to 2 percent surface coating to abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the crushed abrasive particles. Surface coatings to perform the above functions are known to those of skill in the art.

Crushed abrasive particles used in practice of the present disclosure are preferably selected to have a length and/or width in a range of from 0.1 micron to 3500 microns, magnetizable particles have an average maximum particle dimension of 25 to 3000 microns, more typically 100 microns to 3000 microns, and more typically 100 microns to 2600 microns, although other lengths and widths may also be used.

Crushed abrasive particles may be selected to have a thickness in a range of from 0.1 micron to 1600 microns, more typically from 1 micron to 1200 microns, although other thicknesses may be used. In some embodiments, platey crushed abrasive particles may have an aspect ratio (length to thickness) of at least 2, 3, 4, 5, 6, or more.

Length, width, and thickness of the abrasive particles can be determined on an individual or average basis, as desired. Suitable techniques may include inspection and measurement of individual particles, as well as using automated image analysis techniques (e.g., using a dynamic image analyzer such as a CAMSIZER XT image analyzer from Retsch Technology Gmbh of Haan, Germany) according to test method ISO 13402-2:2006 "Particle size analysis—Image analysis methods—Part 2: Dynamic image analysis methods".

In some embodiments, the non-magnetizable particles comprises grinding aid particles. Grinding aids encompass a wide variety of different materials and can be inorganic or organic based. Examples of chemical groups of grinding aids include waxes, organic halide compounds, halide salts and metals and their alloys. Organic halide compounds typically break down during abrading and release a halogen acid or a gaseous halide compound. Examples of such materials include chlorinated waxes like tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron titanium, other miscellaneous grinding aids include sulfur, organic sulfur compounds, graphite and metallic sulfides. It is also within the scope of the present disclosure to use a combination of different grinding aids, and in some instances this may produce a synergistic effect.

Coated abrasive articles according to the present disclosure may be converted, for example, into belts, rolls, discs (including perforated discs), and/or sheets. For belt applications, two free ends of the abrasive sheet may be joined together using known methods to form a spliced belt.

In addition to the description contained hereinabove, further description of techniques and materials for making coated abrasive articles may be found in, for example, U.S. Pat. Nos. 4,314,827 (Leitheiser et al.); U.S. Pat. No. 4,518,397 (Leitheiser et al.); U.S. Pat. No. 4,623,364 (Cottringer et al.); U.S. Pat. No. 4,652,275 (Bloecher et al.); U.S. Pat. No. 4,734,104 (Broberg); U.S. Pat. No. 4,737,163 (Larkey); U.S. Pat. No. 4,744,802 (Schwabel); U.S. Pat. No. 4,770,671 (Monroe et al.); U.S. Pat. No.4,799,939 (Bloecher et al.); U.S. Pat. No. 4,881,951 (Wood et al.); U.S. Pat. No. 4,927,431 (Buchanan et al.); U.S. Pat. No. 5,498,269 (Larmie); U.S. Pat. No. 5,011,508 (Wald et al.); U.S. Pat. No. 5,078,753 (Broberg et al.); U.S. Pat. No. 5,090,968 (Pellow); U.S. Pat. No. 5,108,463 (Buchanan et al.); U.S. Pat. No. 5,137,542 (Buchanan et al.); U.S. Pat. No. 5,139,978 (Wood); U.S. Pat. No. 5,152,917 (Pieper et al.); U.S. Pat. No. 5,203,884 (Buchanan et al.); 5,227,104 (Bauer); and U.S. Pat. No. 5,328,716 (Buchanan).

Coated abrasive articles made according to the methods of present disclosure are useful, for example, for abrading a workpiece. Examples of workpiece materials include metal, metal alloys, exotic metal alloys, ceramics, glass, wood, wood-like materials, composites, painted surfaces, plastics, reinforced plastics, stone, and/or combinations thereof. The workpiece may be flat or have a shape or contour associated with it. Exemplary workpieces include metal components, plastic components, particleboard, camshafts, crankshafts, furniture, and turbine blades. The applied force during abrading typically ranges from about 1 kilogram to about 100 kilograms.

Coated abrasive articles made according to the methods of present disclosure may be used by hand and/or used in combination with a machine. At least one of the coated abrasive article and the workpiece is moved relative to the other when abrading. Abrading may be conducted under wet or dry conditions. Exemplary liquids for wet abrading include water, water containing conventional rust inhibiting compounds, lubricant, oil, soap, and cutting fluid. The liquid may also contain defoamers, degreasers, for example.

Select Embodiments of the Present Disclosure

In a first embodiment, the present disclosure provides a method of making a coated abrasive article, the method comprising sequentially:

providing a backing having first and second opposed major surfaces, wherein a make layer precursor is disposed on at least a portion of the first major surface;

disposing magnetizable abrasive particles onto the make layer precursor while under the influence of an applied magnetic field, such that at least a majority the magnetizable abrasive particles extend away from the make layer precursor in an orientation substantially aligned with the applied magnetic field;

disposing non-magnetizable particles onto the make layer precursor, wherein at least some of the non-magnetizable particles are disposed between the magnetizable abrasive particles while under the influence of the applied magnetic field; and at least partially curing the make layer precursor to provide a make layer.

In a second embodiment, the present disclosure provides a method according to the first embodiment, further comprising:

disposing a size layer precursor over at least a portion of the make layer, magnetizable abrasive particles, and non-magnetizable particles; and at least partially curing the size layer precursor layer to provide a size layer.

In a third embodiment, the present disclosure provides a method according to the second embodiment, further comprising applying a supersize layer over at least a portion of the size layer.

In a fourth embodiment, the present disclosure provides a method according to any one of the first to third embodiments, wherein the magnetizable abrasive particles have an average maximum particle dimension of less than or equal to of 25 to 3000 microns.

In a fifth embodiment, the present disclosure provides a method according to any one of the first to fourth embodiments, wherein the magnetizable abrasive particles have an average aspect ratio of at least 3:1.

In a sixth embodiment, the present disclosure provides a method according to any one of the first to fifth embodiments, wherein the magnetizable abrasive particles comprise a magnetizable layer disposed on at least a portion of a non-magnetizable abrasive particle.

In a seventh embodiment, the present disclosure provides a method according to any one of the first to sixth embodiments, wherein the applied magnetic field is constant.

In an eighth embodiment, the present disclosure provides a method according to any one of the first to sixth embodiments, wherein the applied magnetic field is modulated.

In a ninth embodiment, the present disclosure provides a method according to any one of the first to eighth embodiments, wherein at least a majority of the magnetizable abrasive particles comprise magnetizable abrasive platelets.

In a tenth embodiment, the present disclosure provides a method according to any one of the first to ninth embodiments, wherein at least a majority of the magnetizable abrasive particles comprise magnetizable shaped abrasive particles.

In an eleventh embodiment, the present disclosure provides a method according to any one of the first to eleventh embodiments, wherein said at least partially curing the make layer precursor occurs at a location wherein the applied magnetic field is not sufficiently strong to substantially align the magnetizable abrasive particles with the applied magnetic field.

In a twelfth embodiment, the present disclosure provides a method according to any one of the first to eleventh embodiments, wherein said at least partially curing the make layer precursor occurs at a location wherein the applied magnetic field is not sufficiently strong to substantially align the magnetizable abrasive particles with the applied magnetic field.

In a thirteenth embodiment, the present disclosure provides a method according to any one of the first to the twelfth embodiments, wherein the non-magnetizable particles comprise grinding aid particles.

In a fourteenth embodiment, the present disclosure provides a method according to any one of the first to the twelfth embodiments, wherein the non-magnetizable particles comprise crushed abrasive particles.

In a fifteenth embodiment, the present disclosure provides a coated abrasive article made according to any one of the first to fourteenth embodiments, wherein the magnetizable abrasive particles are shaped as truncated triangular pyramids.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. Unless stated otherwise, all other reagents were obtained, or are available from chemical vendors such as Sigma-Aldrich Company, St. Louis, Missouri, or may be synthesized by known methods. Abbreviations for materials and reagents used in the examples are listed below.

PF1 Phenol-formaldehyde resin having a phenol to formaldehyde molar ratio of 1.5-2.1, and catalyzed with 2.5 percent by weight potassium hydroxide.

BACK1 Polyester backing, according to the description disclosed in Example 12 in U.S. Pat. No. 6,843,815 (Thurber et al.).

FIL1 Calcium Silicate obtained as M400 WOLLASTOCOAT from NYCO, Willsboro, N.Y.

RIO Red iron oxide pigment, obtained as KROMA RO-3097 from Elementis, East Saint Louis, Ill.

MIN1 Shaped abrasive particles were prepared according to the disclosure of U.S. Pat. No. 8,142,531(Adefris et al.). The shaped abrasive particles were prepared by molding alumina sol-gel in equilateral triangle-shaped polypropylene mold cavities. The fired shaped abrasive particles were about 1.40 mm (side length)×0.35 mm thick with a draft angle approximately 98 degrees.

MIN2 ANSI grade 50 Garnet abrasive mineral, obtained from Washington Mills Electro Minerals Corporation, Niagara Falls, N.Y.

MAG1 An N52 Neodymium 20.3 cm diameter disc magnet magnetized through its thickness, supplied by SM Magnetics. Pelham, Ala.

Preparation of Magnetizable Abrasive Particles (Map 1)

MIN1 was coated with 304 stainless steel using physical vapor deposition with magnetron sputtering, 304 stainless steel sputter target, described by Barbee et al. in *Thin Solid Films,* 1979, vol. 63, pp. 143-150, deposited as the magnetic ferritic body centered cubic form. The apparatus used for preparation of 304 stainless steel film coated abrasive particles (i.e., magnetizable abrasive particles) was disclosed in U.S. Pat. No. 8,698,394 (McCutcheon et al.). 3592 grams of MIN1 were placed in a particle agitator that was disclosed in U.S. Pat. No. 7,727,931 (Brey et al., Column 13, line 60). The blade end gap distance to the walls of the agitator was 1.7 mm. The physical vapor deposition was carried out for 12 hours at 5.0 kilowatts at an argon sputtering gas pressure of 10 millitorr (1.33 pascal) onto MIN1. The weight percentage of metal coating in the coated abrasive particles was 0.65% and the coating thickness is 1 micron.

Comparative Example A

The make coat adhesive composition was prepared by charging a 4 liter plastic container with 1521 grams of PF1, 1236 grams of FIL1, mechanically mixing and then diluting to a total weight of 3 kilograms with water.

BACK1 was coated with the make coat adhesive composition at a coating weight of 110.0 grams per square meter (g/m2) using a roll coating method.

BACK1 was placed with the uncoated side down onto the surface of MAG1. MAP1 was deposited onto the top of BACK1 at an approximate weight of 80 grams/$m^2$ which resulted in MAP1 adhering to BACK1 while maintaining an upright orientation. BACK1 was then removed from the magnetic field and set on a wooden table. MIN2 was then applied over the top of BACK1 to full saturation of the surface. The loose MIN2 was then removed by turning the sample upside-down. The resultant abrasive web was then placed in an oven at 65.6 ° C. for 15 minutes followed by 90 minutes at 98.9 ° C.

Example 1

The sample made in Comparative Example A was repeated, except that MIN2 was applied to the top surface of BACK1 prior to removing BACK1 from the magnetic field. The resulting orientation of shape mineral is reported in Table 1, below.

TABLE 1

| | MAGNETIZABLE SHAPED ABRASIVE PARTICLES DEPOSITED | MAGNETIZABLE SHAPED ABRASIVE PARTICLES LAYING DOWN AFTER CURING |
|---|---|---|
| COMPARATIVE EXAMPLE A | 23 | 14 |
| EXAMPLE 1 | 28 | 0 |

All cited references, patents, and patent applications in the above application for letters patent are herein incorporated by reference in their entirety in a consistent manner. In the event of inconsistencies or contradictions between portions of the incorporated references and this application, the information in the preceding description hereinabove shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making a coated abrasive article, the method comprising sequentially:

providing a backing having first and second opposed major surfaces, wherein a make layer precursor is disposed on at least a portion of the first major surface;

disposing magnetizable abrasive particles onto the make layer precursor while under the influence of an applied magnetic field such that at least a majority the magnetizable abrasive particles extend away from the make layer precursor in an orientation substantially aligned with the applied magnetic field;

disposing non-magnetizable particles onto the make layer precursor, wherein at least some of the non-magnetizable particles are disposed between the magnetizable abrasive particles while under the influence of the applied magnetic field; and at least partially curing the make layer precursor to provide a make layer.

2. The method of claim 1, further comprising:

disposing a size layer precursor over at least a portion of the make layer, magnetizable abrasive particles, and non-magnetizable particles; and at least partially curing the size layer precursor layer to provide a size layer.

3. The method of claim 2, further comprising applying a supersize layer over at least a portion of the size layer.

4. The method of claim 1, wherein the magnetizable abrasive particles have an average maximum particle dimension of 25 to 3000 microns.

5. The method of claim 1, wherein the magnetizable abrasive particles have an average aspect ratio of at least 3:1.

6. The method of claim 1, wherein the magnetizable abrasive particles comprise a magnetizable layer disposed on at least a portion of a non-magnetizable abrasive particle.

7. The method of claim 1, wherein the applied magnetic field is constant.

8. The method of claim 1, wherein the applied magnetic field is modulated.

9. The method of claim 1, wherein at least a majority of the magnetizable abrasive particles comprise magnetizable abrasive platelets.

10. The method of claim 1, wherein at least a majority of the magnetizable abrasive particles comprise magnetizable shaped abrasive particles.

11. The method of claim 1, wherein at least a majority of the magnetizable abrasive particles are shaped as truncated triangular pyramids.

12. The method of claim 1, wherein said at least partially curing the make layer precursor occurs at a location wherein the applied magnetic field is not sufficiently strong to substantially align the magnetizable abrasive particles with the applied magnetic field.

13. The method of claim 1, wherein the non-magnetizable particles comprise grinding aid particles.

14. The method of claim 1, wherein the non-magnetizable particles comprise crushed abrasive particles.

15. A coated abrasive article made according to the method of claim 1.

* * * * *